United States Patent [19]

Kosaka

[11] Patent Number: 4,633,790

[45] Date of Patent: Jan. 6, 1987

[54] COMBUSTION CHAMBER APPARATUS AND METHOD

[75] Inventor: Jiro Kosaka, Kanagawa, Japan

[73] Assignee: Meiko Industry Corporation, Ltd., Tokyo, Japan

[21] Appl. No.: 737,564

[22] Filed: May 23, 1985

Related U.S. Application Data

[63] Continuation of Ser. No. 589,688, Mar. 15, 1984, abandoned.

[30] Foreign Application Priority Data

| | | | |
|---|---|---|---|
| Sep. 30, 1981 | [JP] | Japan | 56-145296 |
| Sep. 30, 1981 | [JP] | Japan | 56-145297 |
| Dec. 29, 1981 | [JP] | Japan | 56-197162 |
| May 29, 1982 | [JP] | Japan | 57-80240 |

[51] Int. Cl.[4] ..... F23D 1/00

[52] U.S. Cl. ..... 110/347; 110/102; 110/110; 110/162; 110/165 R; 110/288

[58] Field of Search ..... 110/110, 288, 289, 102, 110/229, 162, 163, 347, 203, 165 R

[56] References Cited

U.S. PATENT DOCUMENTS

| | | | |
|---|---|---|---|
| 146,369 | 1/1874 | Storer | 110/203 |
| 1,928,166 | 9/1933 | Bressler | 110/287 |
| 1,973,590 | 9/1934 | Weaton et al. | 110/288 X |
| 2,119,937 | 6/1938 | Banfield | 110/287 |
| 2,163,291 | 6/1939 | Raddatz | 110/287 |
| 2,370,246 | 2/1945 | Julyan et al. | 110/287 |
| 2,380,260 | 7/1945 | Pilcher et al. | 110/288 |
| 2,524,087 | 10/1950 | Serafini | 110/288 X |
| 3,289,620 | 12/1966 | Heilala | 110/288 |
| 4,007,697 | 2/1977 | Prill | 110/288 |
| 4,078,541 | 3/1978 | Roycraft | 110/260 X |

*Primary Examiner*—Edward G. Favors

*Attorney, Agent, or Firm*—Sandler & Greenblum

[57] ABSTRACT

An apparatus and method for burning fuel in a combustion chamber having an exhaust port. The invention includes a combustion device having a burner head for burning fuel to produce a volitilization zone of high heat. The burner head is positioned in the combustion chamber directly beneath the exhaust port to assure a substantially vertical flame. The upright flame produces a zone of volatilization that continuously contacts the fuel on the burner to vaporize or volatilize a higher percentage of the fuel than in previous combustion apparatuses.

58 Claims, 8 Drawing Figures

COMBUSTION CHAMBER APPARATUS AND METHOD

This application is a continuation of application Ser. No. 589,688, filed Mar. 15, 1984, now abandoned.

BACKGROUND OF THE INVENTION

1. Field of the Invention

The present invention generally relates to an apparatus and method for burning fuel and, more particularly, to an apparatus and method of burning fuel in a combustion chamber.

2. Description of Prior Art

As is well known, plant matter contains volatile contents which vaporize or volatilize readily at relatively low temperatures. This makes plant matter, such as wood, well suited to be used as fuel, because it burns easily. One particular form of wood that is used industrially for fuel is wood pellets. Such pellets are formed by heating wood and compressing it under pressure. Two common types of pelletized wood are pine and cedar wood. Pine and cedar, and particularly their barks are especially good fuels because they contain large amounts of volatile contents.

It has been discovered that the percentage of a wood pellet that varporizes or volatilizes can be increased by placing the pellet in a high temperature environment at 800° C., either prior to or during combustion. 1. Furthermore, it is discovered that the quantity of the gas to be generated by volatilization, such as methane and ethylene, is also increased. This discovery is important because the more fuel that is vaporized or volatilized, the greater the heat that is released 4. , as well as the amount of gas to be generated then. Thus, the combustion of fuel containing volatile contents can be m,de more efficient by heating or preheating the fuel to 800° C.

According to an experiment conducted by the present inventor, 73% of a given amount of pine bark when heated in a high temperature atmosphere of 800° C., 2. with the other factors than temperature being maintained at a certain level vaporized or volatilized; the remainder of the pine was 2.2% ash content and 24.6% fixed carbon. 3. in addition, the quantity of methane and ethylene to be generated when heated at 800° C. is 10 times and 36 times as large, respectively, compared to when heated at 400° C.

A typical furnace burner produces a combustion flame that contains a zone of heat in the flame that is 800° C.

When left undisturbed, this 800° C. zone of heat, called the zone of volatilization, maintains a stable position, enveloping the fuel on the burner. However, conventional boilers and combustion chambers are constructed in a manner which results in the combustion flame being disturbed and unstable, thereby moving the zone of volatilization away from the fuel. Conventional combustion chambers, such as that disclosed by U.S. Pat. No. 4,007,697, typically position an exhaust port at one corner or one side wall at the upper portion of the combustion chamber. As a result, the combustion flame flares toward the exhaust port causing an unstable flame configuration. This causes the zone of volatilization to become unstable and move away from the fuel, thereby decreasing the amount of fuel that is vaporized and burned. There is, therefore, a need for a combustion chamber that allows the flame configuration to be stable, and thereby permits the zone of volatilization to continuously envelope the fuel.

SUMMARY OF THE INVENTION

It is an object of the present invention to provide an apparatus and method for burning fuel that permits the combustion flame to have a stable configuration.

It is still another object of the present invention to provide an apparatus and method for burning fuel that produces a zone of volatilization that continuously contacts the fuel.

It is still further object of the present invention to provide an apparatus and method for burning fuel that releases more heat and burns fuel more efficiently than previous combustion chamber apparatuses.

These and other objects are achieved by the present invention by an apparatus and method for burning fuel in the form of pellets of wood. The apparatus comprises a combustion chamber having an exhaust port and a combustion device. The combustion device includes a burner head for burning fuel to produce a volatilization zone. The burner is so positioned in the combustion chamber in relation to the exhaust port that the volatilization zone substantially continuously contacts the fuel.

The method includes burning fuel in an apparatus including a combustion chamber having an exhaust port and a combustion device. The combustion device includes a burner unit for burning fuel to produce a volatilization zone. The burner unit is so positioned with respect to the exhaust port that the volatilization zone substantially continuously contacts said fuel.

DETAILED DESCRIPTION OF THE PREFERRED EMBODIMENTS

Environment in Which the Invention Is Used

Figure 1:
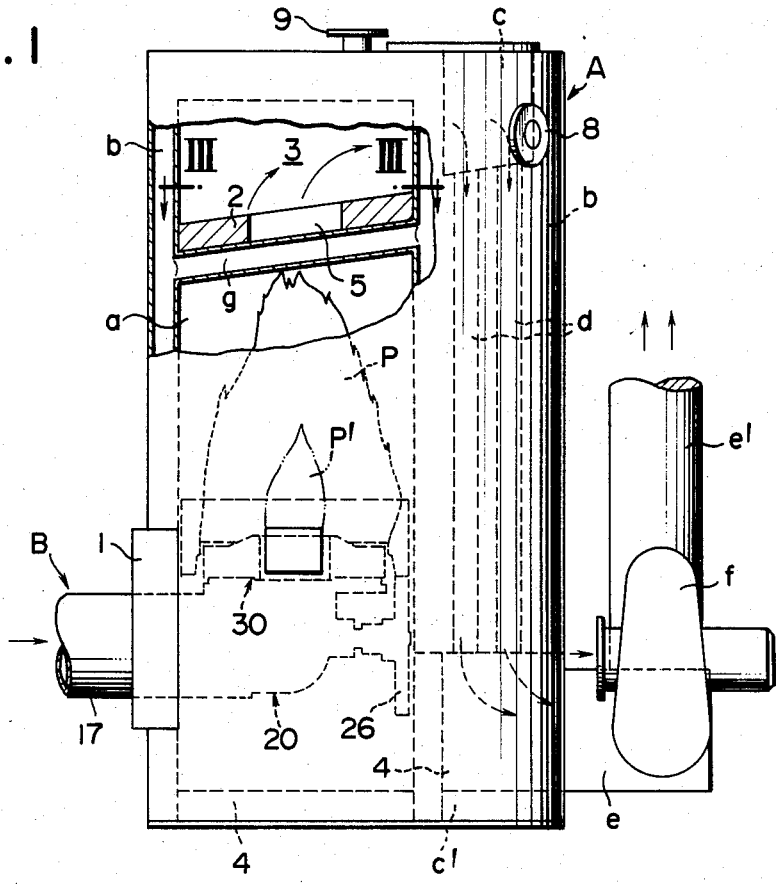
FIG. 1 is a side view, partially in section, illustrating the apparatus of the present invention for use in a boiler.

FIG. 1 illustrates an embodiment of the present invention as used, for example, in a boiler. The boiler generally indicated at A, has three functional components—a combustion device B for burning the fuel, an exhaust system and a cooling system.

These components are all housed in a rigid cylindrical combustion chamber a having top and bottom walls 2 and 4, respectively which are formed by a high-temperature casting procedure.

Top wall 2 is fixed obliquely to the upper part of the combustion chamber to form top space 3 that is used as a passageway for the exhaust that is produced by the combustion device below top wall 2. Exhaust rises in combustion chamber a, passes through an opening or port 5 in the center of the top wall 2. Exhaust port 5 is coaxial with chamber a. The exhaust gas is sucked from port 5 into upper gas duct unit c via exhaust channels 6 formed in the side wall of space 3. From c the exhaust gas passes down vertical gas ducts d, into lower gas duct unit c'. From gas duct unit c' the exhaust gases are passed through exhaust gas unit e and exhaust gas cylinder e' by fan f in cylinder e'. Fan f is arranged within exhaust gas cylinder e'. The fan forcibly exhausts the exhaust gas, and therefore the boiler is a forced exhaust-type boiler.

Figure 2:
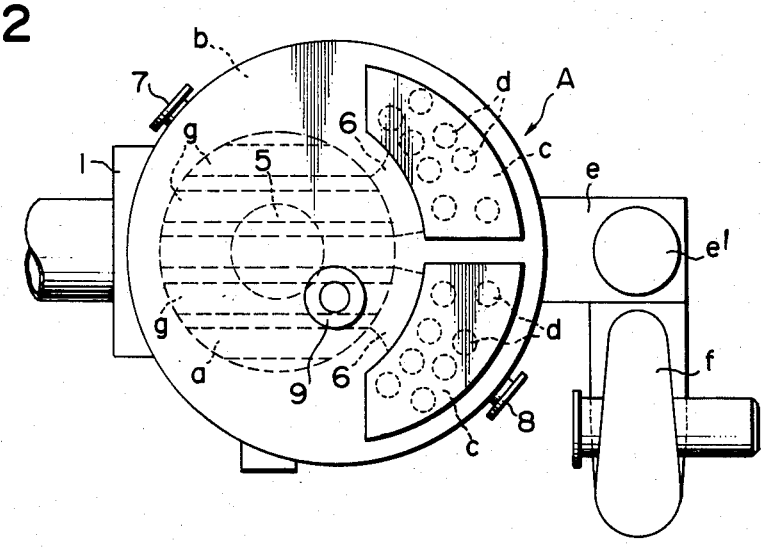
FIG. 2 is a top, planar view of the apparatus illustrated in FIG. 1.
Figure 4:
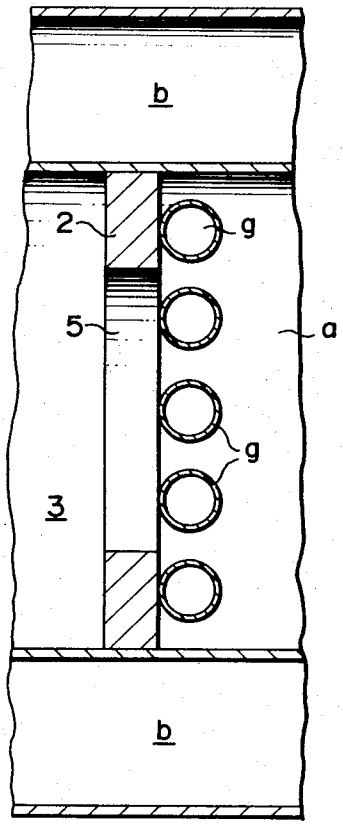
FIG. 4 is a sectional view taken along line IV—IV of FIG. 3.
Figure 3:
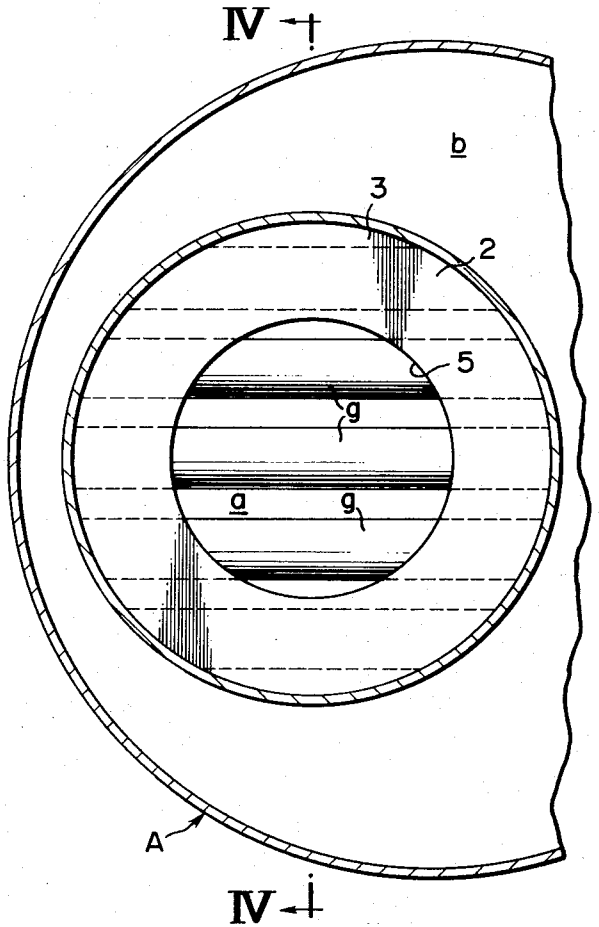
FIG. 3 is an enlarged sectional view of the apparatus of the present invention taken along line III—III of FIG. 1.

The cooling system as seen in FIGS. 1–4 comprises a water tank chamber b, which encircles the outer wall of the boiler, and water pipes g. Pipes g are arranged at predetermined intervals below top wall 2 so as to form a heat exchanger for transferring heat from the hot gases produced by the burner to a fluid flowing through pipes g. As illustrated by FIGS. 1–2, reference numeral 7 denotes an inlet port for the circulation of a suitable fluid, reference numeral 8 indicating the outlet port thereof, and numeral 9 denotes a safety valve as is well understood in the art.

The Combustion Device

The combustion device B, which makes up the present invention, is inserted in an insert port 1 which is formed at the lower part of the outer wall of the boiler A. Thus, burner B sits in the lower part of combustion chamber a.

Figure 5:
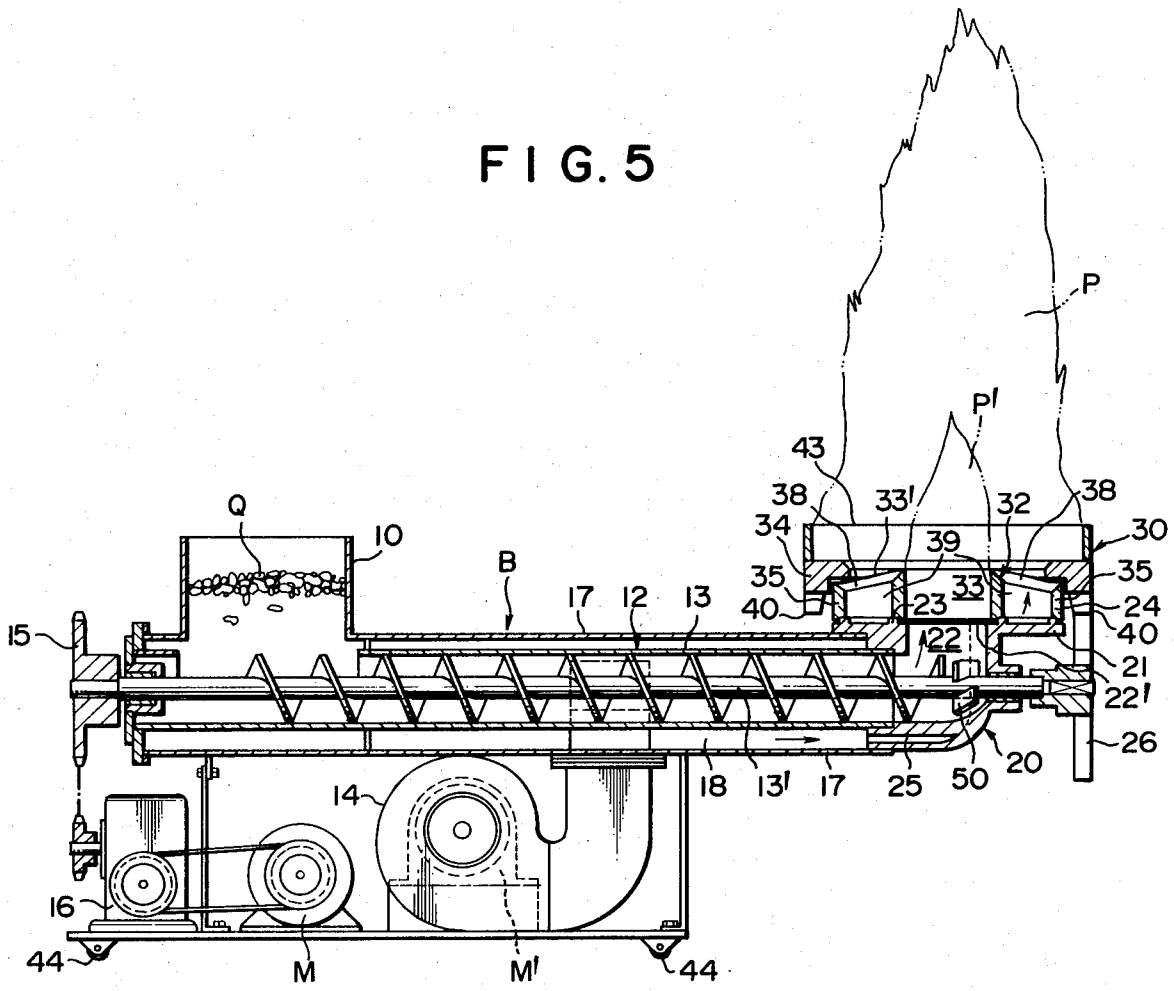
FIG. 5 is a side view, partially in section, illustrating the combustion device of the present invention.

As illustrated in FIG. 5 combustion devices B comprises four primary components—a hopper 10 for holding the fuel, a burner or combustion head 30 for burning the fuel, a conveyor 12 for conveying the fuel from the hopper to the burner head 30, and a blower 14 to supply air to the fuel.

Hopper 10 may have, for example, a box-like body having a V-shaped bottom surface and an open top. The fuel Q that is fed to hopper 10, is, preferably, pellets of pine or cedar bark, obtained by heating and compressing the bark of these trees.

Hopper 10 is disposed at one end of the conveyor 12. Fuel Q is transported from hopper 10 by means of a screw-type conveyor 12 having a transport pipe 13 and screw shaft 13'. The top surface of transport pipe 13 opens below hopper 10 to receive the fuel therein. As conveyor 12 rotates, fuel Q from hopper 10 drops onto conveyor 12 via an opening in transport pipe 13. Fuel Q is then transported to burner head 30 which is mounted at the distal end of screw shaft 13', as will be described hereinbelow.

Conveyor 12 is driven by a driving motor M in the following manner: the proximal end of screw shaft 13' of conveyor 12 extends beyond the edge of transport pipe 13 and is adapted to receive sprocket 15. Sprocket 15 is coupled to driving motor M through a suitable gearing arrangement 16, which may include a reduction mechanism. Thus, driving motor M rotates screw shaft 13' to sequentially feed fuel Q horizontally toward burner head 30.

The first half of transport pipe 13 is encircled by another pipe, an air supply pipe 17 so as to define a double pipe structure having an air supply channel 18 between the two pipes. A blower 14 is connected to air supply channel 18. Blower 14 is driven by driving motor M' independent of driving motor M, so as to blow air to the burner head 30 as shall be described hereinbelow. Because motors M and M' are independent, air may be blown to combusting fuel after fuel conveyor 12 is turned off, thereby completely burning the fuel Q left on the burner head. Thus, no soot or pollution generated by the soot is formed, and the efficiency of the combustion of the fuel is not degraded.

In order for combustion device B to operate properly, the fuel on conveyor 12 must be transported via some structure to burner head 30. In addition, the burner head 30 must be supported and air from blower 14 must reach the burner head 30. All of these functions are carried out by the distal end base 20.

Distal end base 20 is mounted at the distal ends of transport pipe 13 and air supply pipe 17. This mounting is done via a disk-shaped burner head support 21. Support 21 is formed at the upper portion of distal end base 20 such that a bulged portion is provided on the surface of the burner head support 21 facing conveyor 12. The distal ends of transport pipe 13 and air supply pipe 17 are, preferably, coupled to the side surface of the bulged portion of support 21.

Fuel travels to burner head 30 from transport pipe 13 through a curved fuel channel or outlet 22 in base 20. Channel or outlet 22 is connected to the distal end of transport pipe 13. Upper end 22' of channel 22 opens at substantially the center of burner head support 21.

In order to make sure that the fuel is directed toward the upper end 22' of fuel channel 22 from screw shaft 13', a rotary impeller 50 is mounted on screw shaft 13' inside fuel channel 22. Impeller 50 directs fuel toward the upper end 22' of fuel channel 22 without exerting a large load on the screw shaft 13'. Impeller 50 is conveniently twisted in a direction opposite to the threading of the screw shaft 13'. As can be seen from FIG. 5, the distal end of the screw shaft 13' is rotatably supported on the side surface of base 20 to extend outward therefrom. Another impeller 26 is mounted on the distal end of screw shaft 13', for rotation therewith, for a purpose that will be discussed hereinbelow.

Air must also be transported to burner head support 21 and to burner head 30 itself. Air, blown by blower 14, goes from air supply channel 18, to an air channel 25 which is formed in base 20 and which communicates with the distal end of air supply channel 18. Upper end 25' of air supply channel 25 branches into two sections to open between two ribs 23 and 24, formed on the upper surface of the burner head support 21. Ribs 23 and 24 are preferably coaxial with each other and surround the channel 22 by being spaced on the outer and inner perimeter of support 21, respectively. Thus, upper end 25' of air supply channel 25 also surrounds upper end 22' of fuel channel 22. In this way, airr is introduced on each side of the fuel as it goes through the upper end 22' of fuel channel 22.

The final destination of fuel Q is burner head 30. Burner head 30 has two components—stationary burner body 32 and rotating ash ring 34, which coact to burn the fuel, remove the ash, and in combination with the exhaust port 5, ensure the zone of volatilization continuously envelopes the fuel Q.

Figure 6:
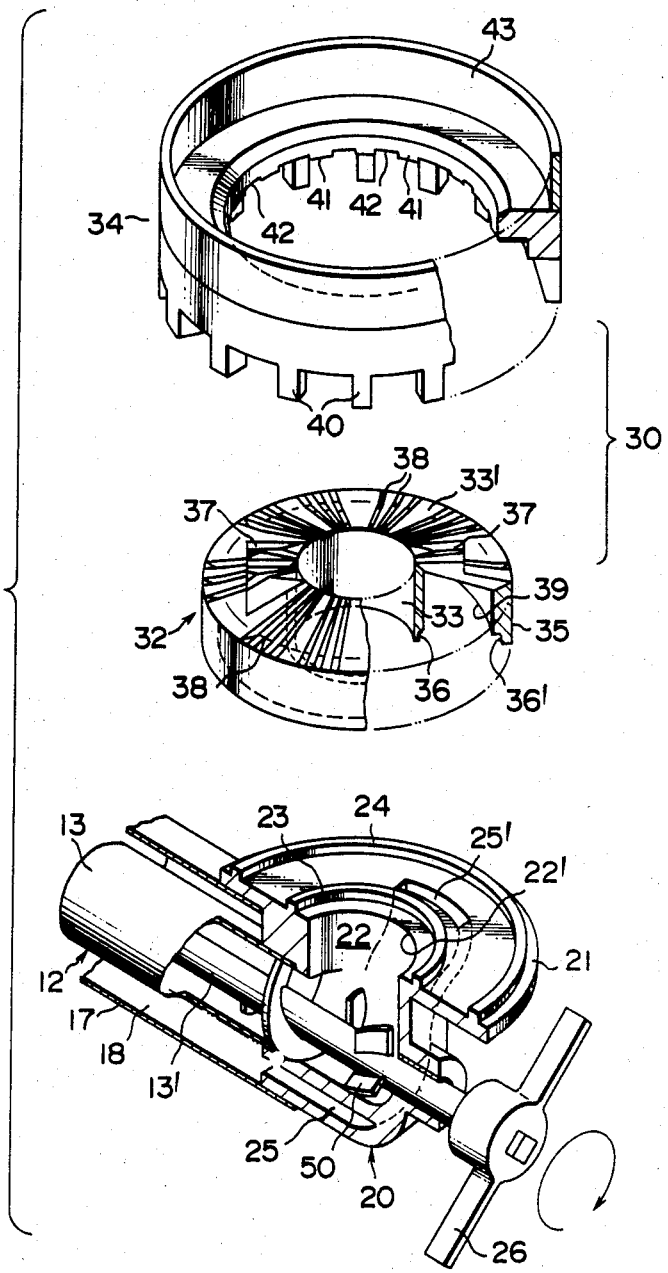
FIG. 6 is an exploded perspective view, partially in section, illustrating the burner unit of the present invention.

The stationary burner body as seen in FIG. 6 comprises an annular body, generally indicated at 32, having a channel 33 therein for guiding fuel Q upward from the fuel channel 22 of base 20, to a slightly downwardly inclined combustion surface 33'. Thus, the fuel travels through channel 33 and then spreads itself over the annular surface of combustion surface 33'.

The burner body 32 is mounted on support 21 with the assistance of notches 36 and 36' on burner body 32 as will now be described. Notch 36 is formed at the lower interior wall of channel 33 and notch 36' is formed at the lower exterior wall of a cylindrical flanged portion 35 on the lower outer edge of combustion surface 33'. When burner body 32 is placed on support 21, the notches 36 and 36' engage the ribs 23 and 24 of support 21, respectively, to hold the burner body 32 thereon.

Two other structural features of the burner body should be noted—the outermost periphery of the downwardly inclined combustion surface 33' is preferably substantially horizontal, and cross sectionally-shaped trapezoidal projections 37 are formed on the inclined part of the surface 33'.

Air is supplied to the burner body 32 from air supply channel 25 in support 20 via a plurality of air supply grooves or channels 38, which extend radially outward from channel 33. These air supply channels 38 communicate with an annular recess 39 formed below the inclined combustion surface 33' and it is through this annular recess that the air from channel 25 passes to reach the air supply channels 38 of the combustion surface 33'.

The final component in the burner 30 is ash ring 34, which removes the ash from combustion surface 33' to assure more efficient combustion. Annular ash ring 34 is of a substantially annular shape and is rotatably supported on the outer edge of stationary burner body 32. Teeth 40, spaced at given intervals, extend downwardly from the lower annular edge of annular ash ring 34 and are placed on the outer edge of burner body 32. Impeller 26 of screw shaft 13' engages the teeth 40 and rotates them in synchronism with the rotation of screw shaft 13'. A second set of teeth 41 are formed on the horizontal portion of the inner edge of the ash ring 34 and extend downward therefrom to define ash outlet ports 42 between teeth 41. Ash which is swept off the combustion surface 33' falls through the ash outlet ports 42. Upright wall 43, prevents scattering of ash formed during the combustion of fuel, and is integral with the outer periphery of the rotary combustion surface 34. As is best illustrated by the sectional view of annular ash ring 34 in FIG. 6, the inner periphery of ash ring 34 has an L-shaped cross-section.

Operation of the System

To operate the system, first combustion device B is wheeled, via wheels 44 on the lower surface of the combustion device B, through inlet port 1 of boiler A. Combustion device B is placed inside the combustion chamber a of boiler A, directly below exhaust port 5, so that the center of the burner body 32 and annular ash ring 34 are in substantial vertical alignment with exhaust port 5 for reasons which will become evident below. Exhaust port 5 is preferably of a slightly smaller diameter than the outer diameter of the combustion surface 33' of the burner body 32.

Next, fuel Q, such as pelletized pine bark, is placed in the hopper 10. Motor M is then turned on and fuel Q drops from hopper 10 onto rotating screw 13' of conveyor 12. Fuel Q travels along the length of screw 13' to fuel channel 22 of the base 20. Impeller 50 assists in forcing fuel Q up channel 22. From channel 22 fuel Q enters channel 33 of burner body 32 and then falls onto inclined combustion surface 33. The fuel pellets are sequentially and continuously supplied to burner head 30 by screw 13'.

During this process of fuel transport, motor M' is turned on, actuating blower 14 to supply air to combustion surface 33'. Air reaches combustion surface 33' by passing from blower 14 though air channel 18, air supply channel 25, the annular recess 31 and air supply grooves 38 of the stationary burner body 32.

At some point during this process, the burner is ignited, as is conventional in the art. As a result, an upright combustion flame P is formed inside combustion chamber a. Combustion flame P extends continuously vertically upward toward exhaust port 5, and does not flicker a great deal.

This stable combustion flame P produces a stable zone of volatilization P', as seen in FIG. 5, that continuously envelopes or contatcs the fuel on the combustion surface 33', and in the upper end of channel 33. Thus fuel that is burned on surface 33' is continuously heated in a zone of volatilization and fuel that is in channel 33 is preheated in a zone of volatilization. Since the fuel is burned in the zone of volatilization, a greater amount of the fuel is vaporized or volatilized 5. and a greater amount of gas, such as methane and ethylene, is produced due to such vaporization or volatilization, thereby generating more heat than known arrangements. As used in this in this disclosure, the volatilization zone, strictly speaking refers to a portion of the flame. However, the term extends to include the zone of high heat that would exist upon ignition, even if such ignition has not as yet occurred. This definition is being adopted for purposes of relating the various elements when ignition has not as yet occurred.

In synchronism with the rotation of screw shaft 13', annular ash ring 34 slowly rotates to cause fuel Q to slide off of inclined combustion surface 33' so that the ash layer or any clinkers of fuel Q that have formed are dropped through ash outlet ports 42 of annular ash ring 34, thereby clearing the combustion surface 33' for receiving fresh fuel which is sequentially supplied by screw 13'.

Alternate Embodiments

Figure 7:
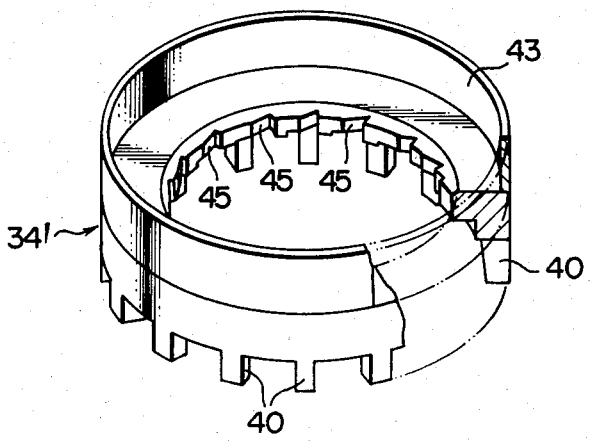
FIG. 7 is a perspective view, partially in section, illustrating an alternative embodiment of the rotary ash ring of the burner of the present invention.

FIG. 7 illustrates an alternative embodiment of ash ring 34. Alternative annular ash ring 34' is provided with notches 45 formed at given, predetermined intervals at the inner peripheral surface of annular ash ring 34'. Each notch 45 is, preferably, formed so as to have a substantially V-shaped section. Thus, each notch has inner surfaces, which together form the two legs of the V. One inner surface or leg of each notch 45 is inclined in the direction of rotation of annular ash ring 34', and the other leg or surface is inclined in the radial direction. These notches 45 facilitates scraping of the ash layer off combustion surface 33', which is formed during the combustion of fuel Q so that combustion efficiency and fuel utilization may be improved.

Figure 8:
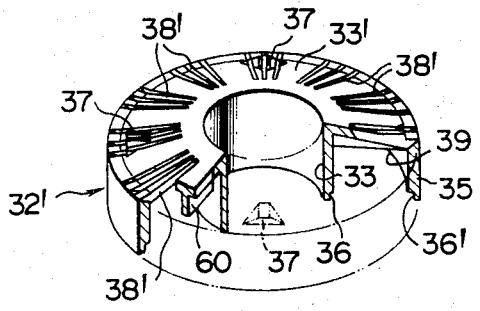
FIG. 8 is a perspective view, partially in section, illustrating an alternative embodiment of the stationary burner body of the burner of the present invention.

FIG. 8 illustrates an alternative embodiment of stationary annular burner body 32. Alternative annular burner body 32' differs from the annular burner body 32 described hereinabove in that air supply grooves 38' do not communicate with channel 33; rather they are formed on inclined combustion surface 33' at a predetermined distance from the upper end of channel 33. Thus, a portion of the combustion surface 33' is devoid of air supply grooves and therefore does not obtain air from blower 14. Thus, combustion is reduced at this portion of the combustion surface 33'. This arrangement reduces the production of ash and clinkers which degrade combustion efficiency.

In addition, this embodiment employs radiating fins 60, having a plate-like shape so as to extend downwardly from the inner top surface of inclined combustion surface 33'. Preferably, radiating fins 60 are formed in misalignment with air supply grooves 38'.

The function of the radiating fins 60 are to radiate excessive heat from combustion surface 33'. This produces a number of desirable effects. First, keeping the temperature of the combustion surface 33' from heating up excessively, prevents clinkers from forming, which degrade combustion efficiency. Second, because the combustion surface temperature is kept lower than conventional structures, heat deterioration and oxidation of the combustion surface are minimized. Finally, the air used for combustion is preheated by the radiating fin 60, thereby returning this heat to the combustion flame, and improving combustion efficiency.

From the foregoing description, one skilled in the art can easily ascertain the central characteristics of this invention and without departing from the spirit and scope thereof can make various changes and modifications of the invention to adapt it to various uses and conditions.

What is claimed is:

1. An apparatus for burning fuel comprising:

a combustion chamber having a side wall and only one exhaust port; and a combustion device including a burner head for burning fuel to produce a volatilization zone having a temperature of approximately 800° C., said burner head being positioned substantially vertically under said exhaust port and spaced from said wall, wherein the diameter of said exhaust port is substantially equal to but smaller than the diameter of said burner head, wherein said combustion chamber, said exhaust port, said position between said exhaust port and burner head, and said side wall and said size of said exhaust port relative to said burner head together comprise means for maintaining said volatilization zone in a substantially stationary position.

2. The apparatus defined by claim 1 wherein said burner head comprises a combustion surface adapted to receive and burn fuel thereon, wherein said maintenance means comprises means for maintaining said volatilization zone in a substantially stable position in contact with said combustion surface.

3. The apparatus defined by claim 2, wherein said burner head further includes a fuel channel having an upper end which communicates with said combustion surface, and wherein said volatilization zone contacts said fuel in said upper end of said fuel channel.

4. The apparatus defined by claim 2, wherein said burner head further includes:

an annular burner body having a combustion surface, wherein ash forms on said surface when fuel is burned thereon; and p1 ash removal means, for removing ash from said combustion surface.

5. The apparatus defined by claim 4, wherein said burner body is stationary and said ash removal means rotates on said combustion surface.

6. The apparatus defined by claim 5, wherein said ash removal means further includes an ash outlet for allowing ash to fall therethrough from said combustion surface.

7. The apparatus define by claim 5, wherein said combustion device further includes a conveyor for conveying fuel to said burner.

8. The apparatus defined by claim 7, wherein said conveyor further includes a screw shaft and a first impeller attached thereto, and wherein said ash removal means includes teeth extending therefrom, such that said teeth engage said first impeller to rotate therewith.

9. The apparatus defined by claim 7, wherein said combustion device further includes:

a hopper for holding fuel and releasing fuel onto said conveyor.

10. The apparatus defined by claim 9, wherein said conveyor further includes an outlet port, and wherein said burner head further includes a fuel supply port which communicates with said outlet port.

11. The apparatus defined by claim 10, wherein said conveyor horizontally feeds said fuel from said hopper and wherein said fuel supply port is vertically above said outlet port so that said conveyor conveys fuel vertically from said outlet port to said fuel supply port, wherein said fuel supply port extends through substantially the center of said burner body, and said burner head further includes a plurality of air supply grooves located radially around said fuel supply port, and wherein said ash removal means is annular in shape and rests on the outer edge of said combustion surface.

12. The apparatus defined by claim 2, wherein said burner head further includes afuel supply port, and said combustion device further includes:

a conveyor for conveying fuel to said burner head, including an outlet port and a directing means to direct said fuel from said outlet port to said fuel supply port.

13. The apparatus defined by claim 12, wherein said conveyor includes a screw shaft, and wherein said directing means is a second impeller, attached to said screw shaft, for directing fuel from said outlet port to said fuel supply port.

14. The apparatus defined by claim 13, wherein said second impeller is twisted in a direction opposite to the direction said screw conveyor is twisted.

15. The apparatus of claim 12, wherein said burner head further includes a plurality of air supply grooves disposed radially on said combustion surface.

16. The apparatus defined by claim 15, wherein said conveyor further includes a screw shaft surrounded by a transport pipe.

17. The apparatus defined by claim 16, wherein said transport pipe has a portion which is surrounded by an air supply pipe to define an air supply channel therebetween, wherein said air supply channel communicates with said air supply grooves of said burner head.

18. The apparatus defined by claim 17 wherein said combustion device further includes a first motor for driving said conveyor and a second motor for driving said blower, wherein said first and second motors operate independently of one another.

19. The apparatus defined by claim 4 wherein said ash removal means rotates on said combustion surface, and wherein said ash removal means has an inner surface having V-shaped notches formed at predetermined intervals thereon, said V-shaped notches comprising means for scraping ashes from said combustion surface.

20. The apparatus defined by claim 11, wherein said conveyor is a screw conveyor including a transport pipe and a screw shaft.

21. The apparatus defined by claim 20, wherein said transport pipe has a portion which is surrounded by an air supply pipe to define an air supply channel therebetween, wherein said combustion device further includes a blower, connected to said air supply channel, and wherein said air supply channel communicates with said air supply grooves of said burner head.

22. The apparatus defined by claim 21, further including a first motor to driving said conveyor and a second motor for driving said blower wherein said first and second motors operate independently of one another.

23. The apparatus defined by claim 20 wherein said screw shaft has a distal end and said conveyor further includes an impeller for scraping said fuel, said impeller comprising means for directing fuel from said fuel outlet port to said fuel supply port, said impeller being mounted adjacent said distal end of said screw shaft.

24. The apparatus according to claim 23, wherein said impeller is twisted in a direction opposite to the direction said screw shaft is twisted.

25. The apparatus defined by claim 11, wherein said ash removal means has an upper surface with an outer edge, and wherein an upright wall of a predetermined height is formed integrally with said outer edge of said upper surface of said ash removal means.

26. The apparatus defined by claim 11, wherein said ash removal means has an inner surface and wherein notches are formed at predetermined intervals on said inner surface of said ash ring, each notch having a substantially V-shaped section comprising two legs, one leg of each of said notches being inclined in the direction in which the rotary ash ring rotates.

27. The apparatus defined by claim 11, wherein said fuel supply port has an upper end and wherein said burner body has an outer edge, and wherein said air supply grooves of said burner body extend from said upper end of said fuel supply port to said outer edge of said burner body.

28. The apparatus defined by claim 27 wherein said burner body includes a radiating fin extending downwardly from said combustion surface.

29. The apparatus defined by claim 11, wherein said fuel supply port has an upper end and wherein said burner body has an outer edge, and wherein said air supply grooves extend from said outer edge of said burner body to a predetermined distance from said upper end of said fuel supply port.

30. The apparatus defined by claim 29 wherein said burner body includes a radiating fin extending downwardly from said combustion surface of said burner body.

31. The apparatus defined by claim 2 wherein said combustion chamber is part of a boiler and said fuel comprises compressed wood pellets.

32. A method of burning fuel in an apparatus including a combustion chamber having only one exhaust port, an outer side wall, and a combustion device having a burner head, said method comprising burning all of said fuel on said burner head substantially vertically under said exhaust port and spaced from said side wall and burning said fuel on said burner head over an area substantially equal to but slightly larger than said exhaust port to produce a volatilization zone having a temperature of approximately 800° C. and maintaining said volatilization zone in a substantially stationary position.

33. The method defined by claim 22, wherein said burner unit comprise a combustion surface and wherein said method further comprises the step of burning fuel on said combustion surface, wherein said method further comprises the step of burning fuel on said combustion surface, wherein said combustion surface has a diameter slightly greater than the diameter of said exhaust port.

34. The method defined by claim 33 wherein said apparatus comprises only one exhaust port and said method further comprises the step of producing exhaust gases as a result of burning said fuel, and exhausting said exhaust gases through said only one exhaust port.

35. The method defined by claim 32 further comprising the step of preheating said fuel in said volatilization zone before said fuel is burned by said burner head.

36. The method defined by claim 32 wherein said burner unit includes a burner head having a combustion surface and a fuel channel, and further comprising the step of maintaining said volatilization zone substantially stable in contact with said fuel on said combustion surface.

37. The method defined by claim 36, wherein said fuel channel has an upper end, and wherein said volatilization zone substantially continuously contacts said fuel in said upper end of said fuel channel.

38. The method defined by claim 36 further comprising forming ash on a combustion surface of said burner body by burning fuel thereon and then removing ash from said combustion surface with an ash removal means.

39. The method defined by claim 38 further comprising rotating said ash removal means on said combustion surface and maintaining said burner body in a stationary position.

40. The method defined by claim 39 further comprising conducting ash through said combustion surface.

41. The method defined by claim 39, said method further comprising conveying fuel to said burner by a conveyor.

42. The method defined by claim 41 further comprising the step of conveying said fuel along said conveyor by a screw shaft, wherein an impeller is attached to said screw shaft, wherein a plurality of teeth extend from said ash removal means and engage said impeller, and wherein said method further comprises rotating said impeller and rotating said ash removal means by the engagement of said teeth with said impeller.

43. The method defined by claim 41 comprising holding said fuel in a hopper and releasing said fuel into said conveyor, horizontally feeding fuel from said hopper onto said conveyor via an outlet port, feeding fuel vertically from said outlet port to a fuel supply port on said burner head, receiving air via a plurality of air supply grooves located radially about said fuel supply port, said ash removal means being annular and resting on an outer edge of said combustion surface.

44. The method defined by claim 37 further comprising conveying fuel to a burner head via a conveyor and directing fuel from an outlet port to a fuel supply port on said burner head.

45. The method defined by claim 44 further comprising supplying air to said burner body via a plurality of air supply grooves disposed about said combustion surface.

46. The method defined by claim 45 further comprising conveying fuel to said burner head via a screw shaft surrounded by an air transport pipe, and supplying air to said transport pipe via an air supply pipe surrounding at least a portion of said transport pipe to thus fluidically communicate an air supply channel formed between said air supply pipe and said transport pipe with the air supply grooves of said burner head.

47. The method defined by claim 32 wherein said method further comprise burning compressed wood chips on said burner head.

48. The apparatus defined by claim 1 wherein said side wall comprises an outer wall of said combustion chamber wherein only said burner head is positioned between said combustion device and said side wall thereby producing a continuous empty space between said burner head and said side wall.

49. The apparatus defined by claim 1 wherein said burner head comprises a floor for supporting said fuel and an outer edge, and wherein said combustion device further comprises a vertical wall extending vertically upward from said floor at said outer edge of said burner head whereby said vertical wall comprises means for preventing any combustion products formed by burning said fuel from collecting between said burner head and said side wall.

50. The apparatus defined by claim 49 further comprising a fan connected to said exhaust port for pulling combusted gases from said combustion chamber to said exhaust port.

51. The method recited by claim 32 further comprising the step of preventing any combustion products formed by burning said fuel from collecting between said burner head and said side wall with a vertical wall extending upwardly from the floor of said burner head, at the outer edge of said burner head.

52. An apparatus for burning fuel comprising:

a combustion chamber having a side wall comprising an outer side wall of said combustion chamber and only one exhaust port; and a combustion device including a burner head for burning fuel to produce a volatilization zone, said burner head being positioned substantially vertically under said exhaust port and spaced from said wall, wherein the diameter of said exhaust port is substantially equal to but smaller than the diameter of said burner head, wherein said combustion chamber, said exhaust port, said relative position between said exhaust port and burner head, and said side wall, and said size of said exhaust port relative to said burner head together comprise means for maintaining said volatilization zone in a substantially stationary position.

53. The apparatus defined by claim 52 wherein only said burner head is positioned between said combustion device and said side wall.

54. The apparatus defined by claim 52 further comprising means for preventing any combustion products formed by burning said fuel on said burner head from collecting between said burner head and said side wall.

55. A method of burning fuel in an apparatus including a combustion chamber having only one exhaust port, a side wall comprising an outer wall of said combustion chamber and a combustion device having a burner head, said method comprising burning all of said fuel on said burner head substantially vertically under said exhaust port and spaced from said side wall and burning said fuel on said burner head over an area substantially equal to but slightly larger than said exhaust port to produce a volatilization zone and maintaining said volatilization zone in a substantially stationary position.

56. The method defined by claim 53 further comprising the step of preventing any combustion products formed by burning said fuel from collecting between said burner head and said side wall.

57. An apparatus for burning fuel comprising:

a combustion chamber having a side wall comprising an outer wall of said combustion chamber and only one exhaust port; and a combustion device including a burner head for burning fuel to produce a volatilization zone, said burner head being positioned substantially vertically under said exhaust port and spaced from said wall, wherein the diameter of said exhaust port is substantially equal to but smaller than the diameter of said burner head, wherein said burner head comprises a floor for supporting said fuel and an outer edge, and wherein said combustion device further comprises a vertical wall extending vertically upward from said floor at said outer edge of said burner head whereby said vertical wall comprises means for preventing any combustion products formed by burning said fuel from collecting between said burner head and said side wall.

58. The apparatus defined by claim 1 wherein only said burner head is positioned between said combustion device and said side wall thereby producing a continuous empty space between said burner head and said side wall.

* * * * *